United States Patent [19]

Sameshima

[11] 4,064,700

[45] Dec. 27, 1977

[54] MARINE ENGINEERING STRUCTURE WITH WIDE BASE USING A TRUSS

[75] Inventor: Shigeru Sameshima, Kikuna, Japan

[73] Assignee: Japan Port Consultants, Ltd., Tokyo, Japan

[21] Appl. No.: 701,218

[22] Filed: June 30, 1976

[30] Foreign Application Priority Data

Aug. 7, 1975 Japan ..... 50-96174

[51] Int. Cl.[2] ..... E02B 3/06; E02D 27/00

[52] U.S. Cl. ..... 61/4; 61/30; 61/49; 61/50

[58] Field of Search ..... 61/3, 4, 30, 50, 86, 61/49, 37

[56] References Cited

U.S. PATENT DOCUMENTS

| | | | |
|---|---|---|---|
| 1,146,229 | 7/1915 | Adamson | 61/3 |
| 2,014,116 | 9/1935 | Powers | 61/4 |
| 3,783,626 | 1/1974 | Hansen | 61/50 X |

FOREIGN PATENT DOCUMENTS

| | | | |
|---|---|---|---|
| 84,272 | 2/1957 | Netherlands | 61/86 |
| 9,680 of | 1843 | United Kingdom | 61/4 |

*Primary Examiner*—Jacob Shapiro

*Attorney, Agent, or Firm*—Toren, McGeady and Stanger

[57] ABSTRACT

A marine engineering structure with a wide base comprising a truss structure constructed by interconnecting a plurality of long trusses spacedly erected vertically and by fixing a floor slab to thin lower end thereof, and prefabricated main body of said marine engineering structure inserted into a space provided by said truss structure.

6 Claims, 2 Drawing Figures

MARINE ENGINEERING STRUCTURE WITH WIDE BASE USING A TRUSS

BACKGROUND OF THE INVENTION

1. Field of the Invention

The present invention relates to marine engineering structure including revetment, breakwater and quay walls having a wide base and constructed with trusses.

2. Description of the Prior Art

Conventionally, there have been proposed a number of methods for constructing marine engineering structures, which can be selected according to the purposes for which they are intended, soil conditions of the construction site, and other factors. In recent years, however, there has been increasing demand for shortening the period of construction work. For example, rapid construction methods, such as submerging and settling prefabricated concrete caissons at predetermined locations, are employed.

However, such conventional rapid construction methods as just mentioned have such common shortcomings that the sea bed on which caissons rest subsides under their load, etc., making the structures unstable. In many cases, therefore, preliminary works, such as foundation improvement, must be carried out before constructing revetments, breakwaters or other marine engineering structures. However, foundation improvement works can often give rise to secondary pollution problems as a result of diffusion of sea bed sludge and leakage of solidifying agent injected into the sea bed. Such a method is not recommendable for these and other reasons, such as higher costs and problems resulting from conventional rapid construction processes.

SUMMARY OF THE INVENTION

The present invention is to eliminate such shortcomings, providing a marine engineering structure especially suitable for rapid works for constructing a large-scale marine engineering structure (for example 15 meters in height). Thus the present invention provides a marine engineering structure comprising a truss structure which comprises a plurality of trusses spacedly erected vertically, a connecting member for interconnecting the trusses, and floor slab fixed to the lower end of the trusses, said truss structure providing a space into which the prefabricated main body of said marine engineering structure is inserted.

DETAILED DESCRIPTION OF THE INVENTION

The present invention is to provide a marine engineering structure constructed in such manner that a plurality of trusses are spacedly erected vertically and are inter-connected by steel members, or other materials and floor slabs are laid over the entire bottom to form a truss structure having wide base, and that after sinking and settling said truss structure onto sea bed, the prefabricated main body of the marine engineering structure (for example, hollow square concrete column) is inserted into, and fixed in place among, said trusses in a row. Also, according to purposes, riprap, wave-breaking blocks, or other materials may be placed for protection of the sea bed in the front of or in the rear of the structure. The main body of the marine engineering structure does not necessarily have to be a single structure.

In such structure as mentioned above, by inserting and fixing in place the main body of a marine engineering structure into truss structures submerged and settled onto a predetermined position in the sea bed, said main bodies can be very rapidly constructed and at the same time, satisfactory stability of the main bodies can be achieved, facilitating various incidental works to be done subsequently. Furthermore, since the weight of the structure (chiefly the weight of the main bodies) is distributed to the side floor slab of the truss structure to reduce the pressure per unit area bearing on the base, and since said main bodies are supported by the truss structures, they can be appreciably simple in construction and yet provide sufficient structural stability, as compared with conventional types. This permits the total weight of the structure to be comparatively small. Therefore, its applicability to soft foundation will be greatly increased, without employing conventional foundation improvement processes.

DESCRIPTION OF PREFERRED EMBODIMENTS

Now the present invention will be explained referring to an example shown in the drawings.

Figure 1:
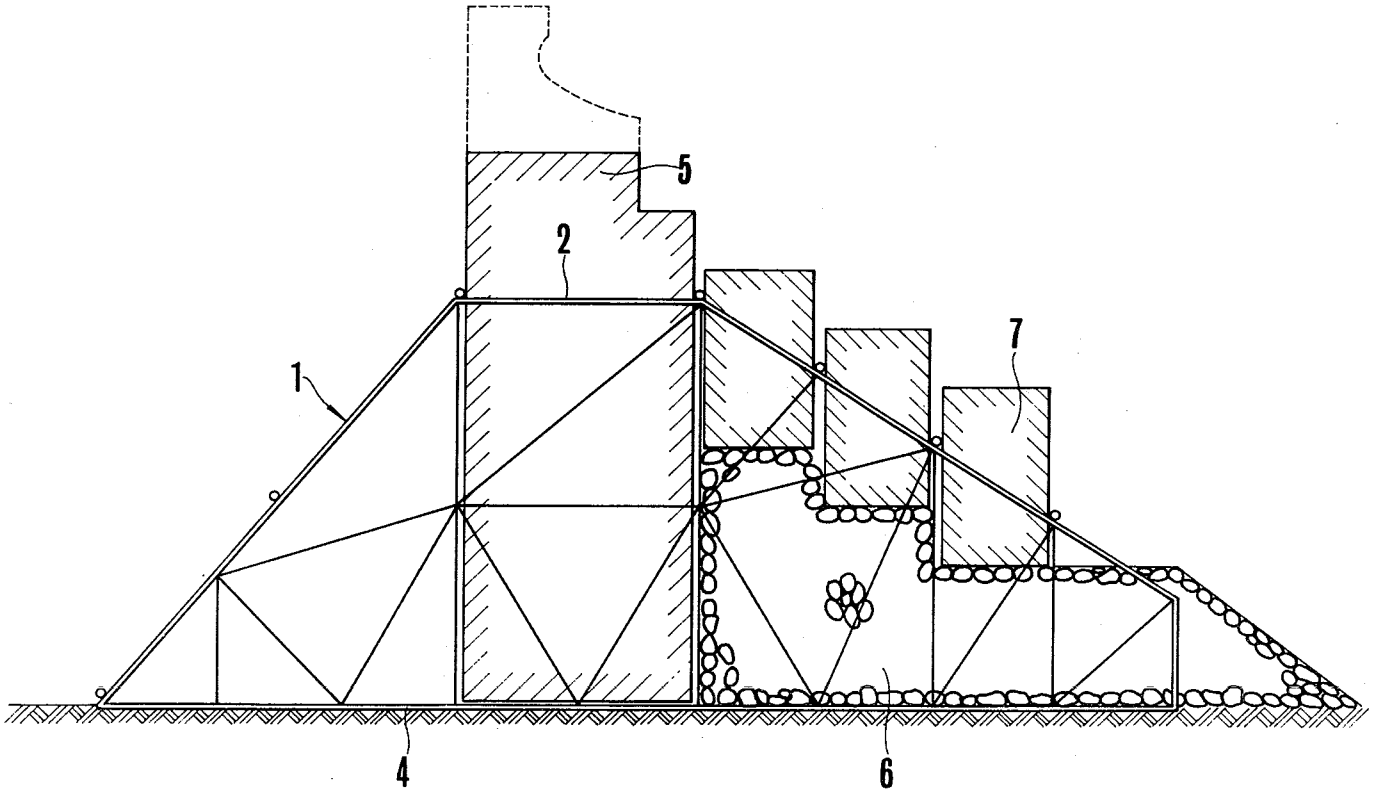
FIG. 1 and FIG. 2 show a marine engineering structure intended for use as a bulkhead or breakwater.
Figure 2:
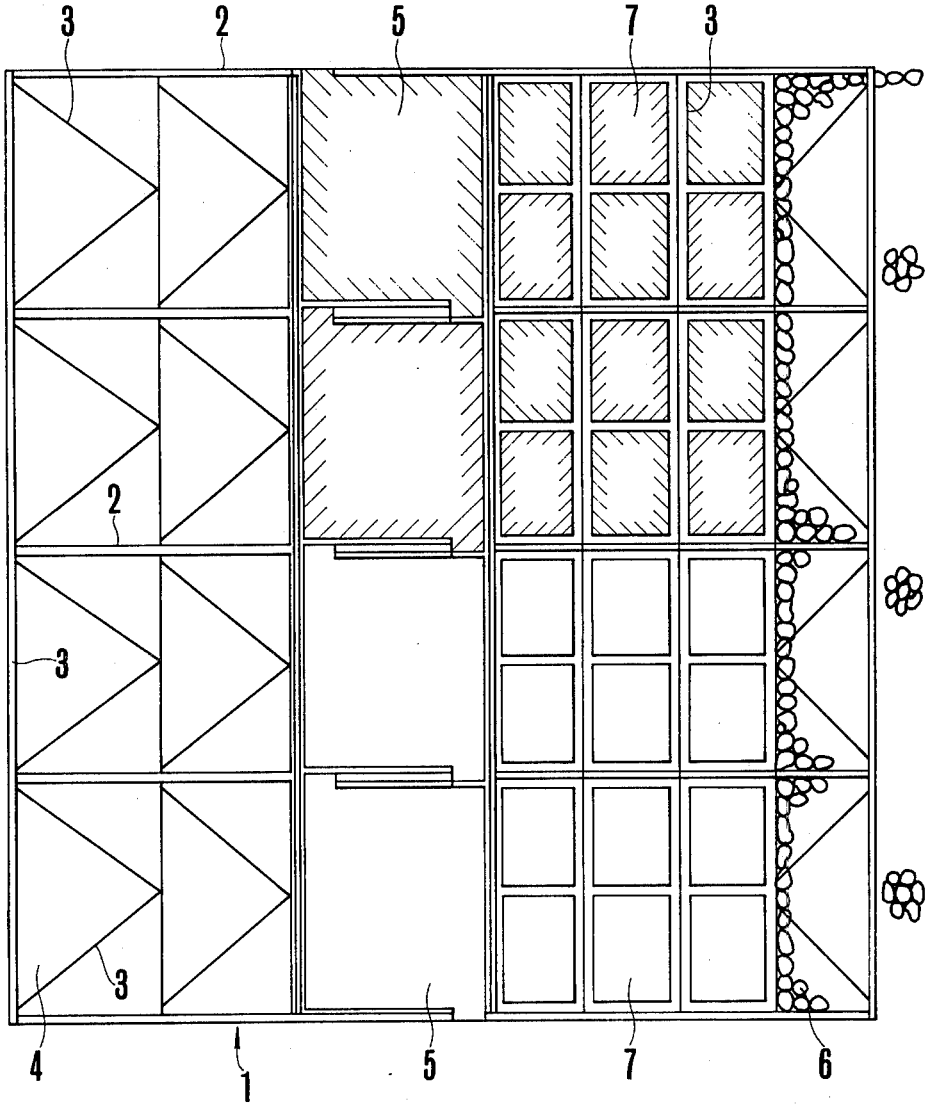

In the drawings, 1 is a vertically extending truss structure with a horizontally arranged base. As already mentioned, the truss structure 1 is constructed by spacedly erecting vertically a plurality of open-sided trusses 2, interconnecting them by steel members 3 or other materials, and by fixing floor slab 4 to the entire base.

Truss structure 1 thus built will be submerged and settled onto a predetermined sea bed position. The main bodies 5 prefabricated on shore (for example, hollow square concrete columns) will then be inserted through upper openings of the truss structure 1 and fixed in place to provide fills. By executing said work between trusses 2 in turns or simultaneously, the main bodies of the marine engineering structure will be formed in a row.

The truss structure 1 may not fit right into the uneven surface of the sea bed as it has a very wide floor slab 4. In such case, openings (not shown in the drawings) can be provided beforehand at the floor slab 4 to pump in sand or other material through such openings after said structure 1 has been submerged and settled onto the sea bed, with a view to adjusting the sea bed surface, so as to secure structural stability.

The main bodies of the marine engineering structure of the present invention can be completed in this manner. Depending on the purposes for which the marine engineering structure is intended, for example, in the case of a breakwater, riprap 6 will be provided on front offshore side of said structure and additionally wave-breaking blocks 7 laid, thus completing the entire construction works.

As explained above, the marine engineering structure to which the present invention relates can be almost completed by a rapid construction method whereby the prefabricated main bodies of concrete or other material are inserted and fixed in place into truss structure having a base. Since the main bodies of said marine engineering structure can be of simple and light construction as compared with those of similar dimensions built by conventional methods, they are easier to form and transport and as such are less costly. Further, the total weight of the marine engineering structure will be distributed all over the wide floor slab, reducing the pressure per unit area and possibility of a decrease in structural stability resulting from subsidence of the sea bed or other causes. All this adds greatly to the applicability of said marine engineering structure to soft foundation as well as its practical utility.

What is claimed is:

1. A marine engineering structure, such as a revetment, a breakwater or a quay wall, comprising at vertically extending truss structure having a horizontally arranged base at the lower end thereof, said truss structure comprising a plurality of vertically extending open-sided trusses spaced laterally apart, a plurality of interconnecting members joined to and extending between said trusses, said trusses and said interconnecting members dividing the interior of said truss structures into a plurality of vertically extending multi-sided open spaces extending upwardly above the base of said truss structure, a floor slab fixed to the base of said truss structure and extending transversely of the lower ends of said vertically extending open spaces, and at least one vertically extending prefabricated main body located within one of said open spaces and extending vertically upwardly from said floor slab, and said main body comprising a unitary block-like structure.

2. A marine engineering structure, as set forth in claim 1, wherein said floor slab extends across the entire base of said truss structure.

3. A marine engineering structure, as set forth in claim 2, wherein a plurality of said main bodies being located within said open spaces in said truss structure disposed laterally of one another and each extending vertically upwardly from said floor slab.

4. A marine engineering structure, as set forth in claim 4, wherein said main bodies comprise hollow square concrete columns.

5. A marine engineering structure, as set forth in claim 2, wherein rip-rap being filled into certain of the open spaces located laterally of the open space containing said main body.

6. A marine engineering structure, as set forth in claim 2, wherein wave-breaking blocks being filled into certain of said open spaces located laterally of said open space containing said main body.

* * * * *